United States Patent [19]

Miller

[11] 4,212,607

[45] Jul. 15, 1980

[54] FIBER DISTRIBUTOR

[75] Inventor: Fredric N. Miller, Menasha, Wis.

[73] Assignee: American Can Company, Greenwich, Conn.

[21] Appl. No.: 918,691

[22] Filed: Jun. 23, 1978

[51] Int. Cl.[2] ..... B28B 5/00

[52] U.S. Cl. ..... 425/83.1

[58] Field of Search ..... 425/80, 81, 82, 83.1

[56] References Cited

U.S. PATENT DOCUMENTS

| | | | |
|---|---|---|---|
| 2,912,723 | 11/1959 | Roberts | 425/83.1 |
| 3,644,078 | 2/1972 | Tachibana et al. | 264/128 |
| 4,014,635 | 3/1977 | Kroyer | 425/82.1 |

*Primary Examiner*—Donald J. Arnold
*Assistant Examiner*--James R. Hall
*Attorney, Agent, or Firm*—Robert P. Auber; George P. Ziehmer; Harry W. Hargis

[57] ABSTRACT

An improvement in distributors for air-laid fibers wherein one or more impellers within a distributor housing receive fibers from a hammer mill or other source, and impel fibers smaller than a certain size through a first screen extending over the outlet opening of the distributor housing onto a moving forming wire. A partial vacuum is formed beneath the forming wire to hold the fibers thereon and to form a continuous web of fibrous material. The impellers are blades which rotate about a vertical shaft immediately above the first screen. The invention is directed to improvements in the first screen, wherein it is endless and is mounted for movement across the outlet opening of the distributor housing, in the same direction and at the same speed as the forming wire.

2 Claims, 2 Drawing Figures

FIBER DISTRIBUTOR

BACKGROUND OF THE INVENTION

The closest prior art is the disclosure of U.S. Pat. No. 4,014,635, which issued Mar. 29, 1977, to Karl Kristian Kobs Kroyer for an "Apparatus for the Deposition of a Uniform Layer of Dried Fibers on a Foraminous Forming Surface".

The Kroyer apparatus comprises a distributor including a housing which is substantially rectangular, having curved side wall sections. One or more propeller-like impellers are within the distributor housing and spin about one or more vertical shafts. Fibrous material such as paper pulp is introduced above the impellers. Optionally, a screen may be used ahead of the impellers initially to screen particularly large fibers. A vacuum port is connected to the housing to remove extra large fibers and to return them to a hammer mill where they may be reduced to smaller fibers and returned to the distributor. The distributor housing has an opening at its lower end, below the impellers, and a screen extends over the opening to prevent passage therethrough of fibers larger than a predetermined size. Below that screen is a forming wire for receiving fibers that pass through the screen. Movement of the forming wire spreads the fibers into a continuous web. The region below the forming wire is partly evacuated to induce air flow downwardly from the distributor through the screen over the distributor opening, and through the forming wire, thereby holding the formed fibrous web on the forming wire. The forming wire preferably is in a tunnel, and the tunnel is substantially sealed at both ends by a pair of rollers.

Unfortunately, the motion of the forming wire tends to cause the fibers to align or orient in the direction of travel, thereby forming a web which is stronger in one direction than in another. It is desirable that the fibers be randomly oriented to give a substantially isotropic strength to the fibrous web.

SUMMARY OF THE INVENTION

To deliver fibers to the moving forming wire in a random distribution, the apparatus of this invention provides an endless screen mounted for movement over the bottom outlet opening of a distributor housing, and through which the fibers are directed onto the moving forming wire. The endless screen conveniently extends upwardly from sides of the distributor housing and across its top. The screen is driven so that the portion extending over the outlet opening travels in the same direction and preferably at the same speed as the forming wire. In this way, with no relative velocity between the screen and the forming wire, the fibers are not oriented primarily in the direction of motion of the forming wire, but are randomly oriented.

Between the screen and the forming wire is means defining a tunnel having sealing rolls at both ends for limiting the amount of spurious air flow into the tunnel at its ends. The sealing roll at the exit end of the tunnel typically compresses the deposited web. A vacuum chamber produces a partial vacuum under the forming wire to cause the delivered fibers to adhere to the forming wire and form a continuous web of fibrous material.

It is, therefore, an objective of this invention to deliver fibers and to deposit the same with random orientation onto a forming wire.

To that end, it is an objective of this invention to provide a continuously moving screen for sifting fibers onto a forming wire which is moving at substantially the same velocity and the same direction as the screen.

Other objectives will become apparent from the following description, taken in connection with accompanying drawings.

DESCRIPTION OF THE PREFERRED EMBODIMENT

Figure 1:
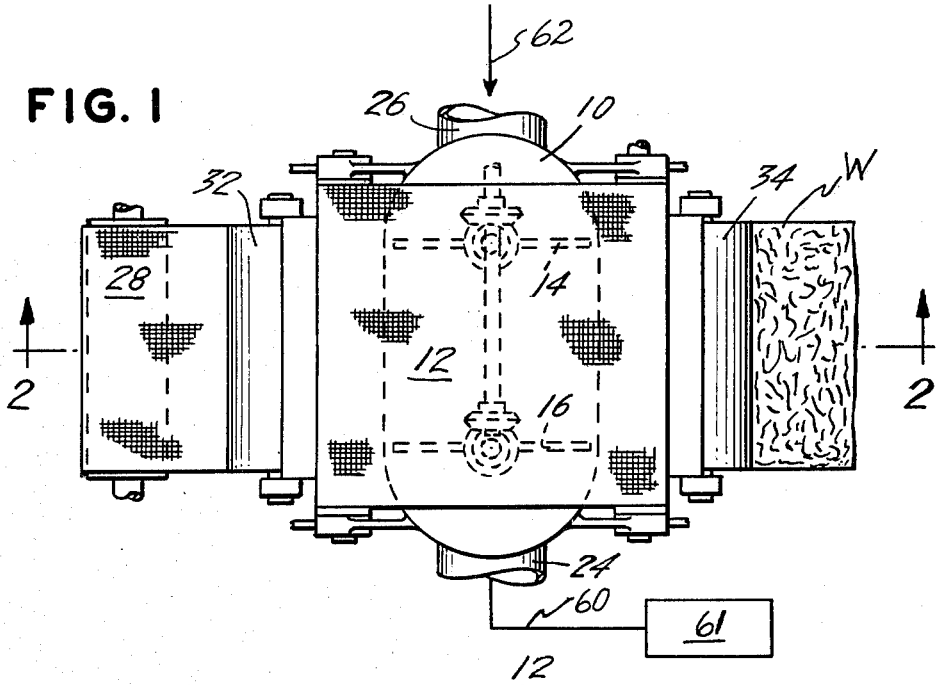
FIG. 1 is a top plan view of a typical apparatus embodying the invention.

This application pertains to improvements over the Kroyer apparatus. With more detailed reference to the drawing, apparatus embodying the invention comprises a fiber distributor including a housing 10, a horizontally movable screen 12 extending over a downwardly facing bottom outlet opening **12*a* at the lower end of housing 10, and impellers 14, 16, and 18 on a vertical shaft 20 driven by suitable means (not shown). The impellers are mounted closely above the planar-surface screen 12**.

Housing 10 also has an inclined plate 22 extending inwardly from its inner walls to channel incoming fibers toward the center of the housing. Above the plate 22 there is a port 24 connected to a recycle pipe 60 leading to a fiber reservoir or hammer mill 61. The pipe leading from port 24 may have a fan therein to withdraw large fibers from the housing. Fibers are introduced to housing 10 through an inlet port 26, as is indicated by directional arrow 62.

Figure 2:
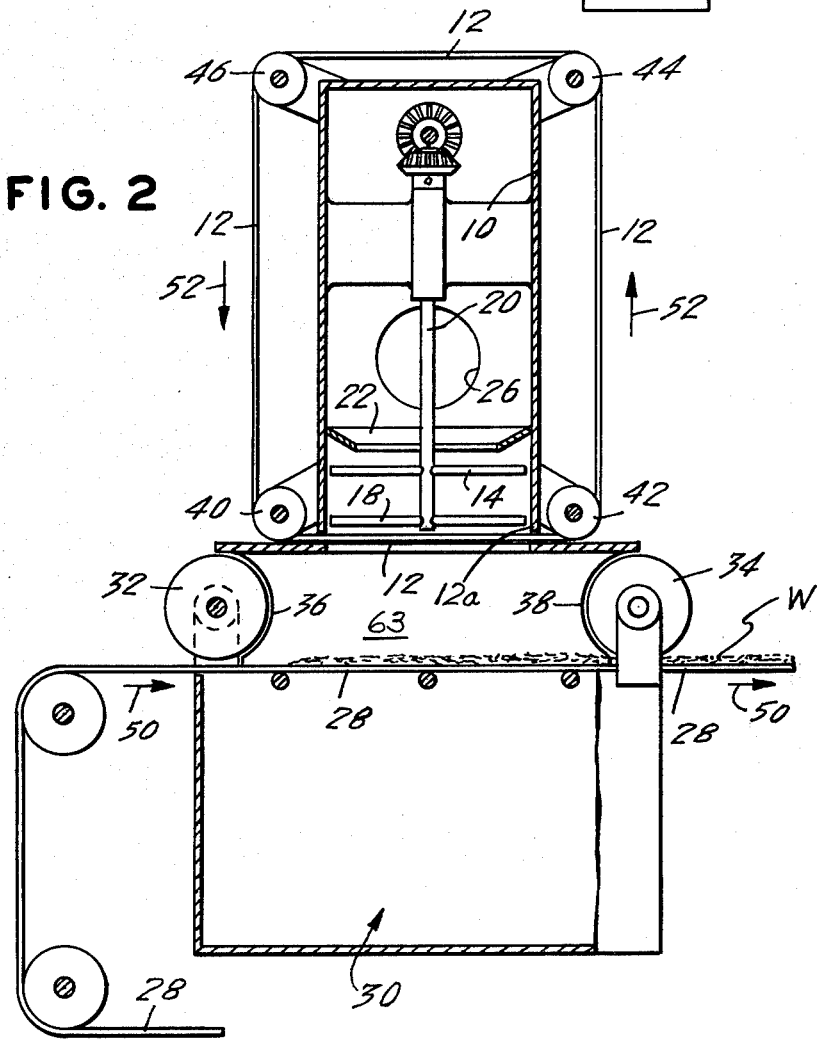
FIG. 2 is a sectional view taken generally along the line 2—2 of FIG. 1, looking in the direction of arrows applied thereto.

A forming wire 28 is positioned and supported for unidirectional travel continuously below screen 12 extending over the outlet opening **12*a* in housing 10. A vacuum chamber 30 is located below the forming wire 28 to hold a web of fibers thereon. A pair of rollers 32 and 34 at opposite ends of a tunnel are mounted for rotation about axes extending transversely of the direction of movement of the forming wire 28. The rollers are mounted so that gaps 36 and 38 are formed between the lower, extended edges 63 (FIG. 2) of the housing 10 and the roller surfaces to form the tunnel through which the forming wire 28 travels. The rollers may be positively driven or may rotate on the forming wire 28**. Means for driving the impellers, the rollers, and the forming wire are not shown.

The improvement of this invention comprises the endless screen 12 in place of the fixed bottom screen in the Kroyer patent. The screen 12 is stretched on rollers at the two bottom sides and the two top sides of the housing 10, so that the portion of the screen 12 traveling over opening **12*a* is the sole portion thereof confronting the forming wire. These rollers 40, 42, 44, 46 prevent the screen from rubbing the housing 10 and maintain tension of the screen. At least one of the four rollers is driven by motive means (not shown) to drive screen 12**.

Forming wire 28 moves in the direction shown by the arrows 50, and screen 12 moves in the direction shown by the arrows 52. In a preferred embodiment of invention, the velocity of the two screens 12 and 28 are substantially the same so that fibers which are forced through the openings in screen 12 have a component of velocity in the direction of the arrow 50, whereby the sudden impact of those fibers on the forming wire 28 does not cause alignment or orientation of the fibers in the direction of the arrow 50.

Dry fibers are delivered to housing 10 through conduit 26. Fibers which are too large to pass through openings of screen 12 are withdrawn through conduit 24. Shelf 22 directs the incoming fibers toward the impellers which may be simple metal bars. Alternatively, the impellers may have some torsion, similar to an airplane propeller. Fibers are sifted through the moving screen 12, and are drawn therethrough by the pressure differential created by vacuum chamber 38, which also produces a partial vacuum in the tunnel between forming wire 28 and moving screen 12. The down-falling fibers, having a velocity in the direction of arrow 50, are deposited on belt 28 and moved outwardly under roller 34 to form a continuous web W of fibrous material.

While screen 12 conveniently is shown outside the housing 10, it may be inside the housing 10, if desired. Further, although screen 12 is shown encircling housing 10, it need not do so. The belt return may be any kind of return, the essential disposition being such that it moves across the opening 12*a* of housing 10 in order to screen the fibers.

Although a preferred embodiment of the invention has been described it is not intended that the invention should be limited thereto, but only in accordance with the description taken in light of the appended claims.

I claim:

1. An apparatus for forming a uniform web of dry fibers, comprising: a fiber distributor including a housing having a bottom outlet opening; driven impellers in said housing adjacent said opening; means defining a tunnel extending beneath said opening, in air flow communication therewith; a forming wire disposed beneath said opening, and mounted for unidirectional travel through said tunnel; means for sealing the ends of said tunnel against air leakage while accommodating the recited travel of said forming wire; means for producing a vacuum below said forming wire; a screen mounted for unidirectional travel over said bottom outlet opening and above said tunnel, said last recited travel being in the direction of travel of said forming wire, that portion of the screen traveling over said opening being the sole portion thereof confronting said forming wire; and means for introducing dry fibers to said distributor housing for discharge from said bottom outlet opening, under the influence of said impellers, through said screen onto said forming wire as said screen and said forming wire travel, respectively, above and through said tunnel.

2. The apparatus of claim 1, wherein said screen and said forming wire travel at substantially the same speed.

* * * * *